US008430274B2

(12) United States Patent
van der Heijden et al.

(10) Patent No.: US 8,430,274 B2
(45) Date of Patent: Apr. 30, 2013

(54) FOAM DISPENSING ASSEMBLY

(75) Inventors: Edgar Ivo Maria van der Heijden, Broek Op Langedijk (NL); Peter Jozef Jan Albertz, Haarlem (NL); Sylvia Boshuizen, Leiden (NL); Marcus Cornelis Jacobus Tepas, Callantsoog (NL); Casper Kleiman, Alkmaar (NL)

(73) Assignee: Rexam Airspray N.V., Alkmaar (NL)

( * ) Notice: Subject to any disclaimer, the term of this patent is extended or adjusted under 35 U.S.C. 154(b) by 402 days.

(21) Appl. No.: 12/676,956

(22) PCT Filed: Sep. 10, 2008

(86) PCT No.: PCT/NL2008/000200

§ 371 (c)(1),
(2), (4) Date: Mar. 8, 2010

(87) PCT Pub. No.: WO2009/038454

PCT Pub. Date: Mar. 26, 2009

(65) Prior Publication Data

US 2010/0320232 A1 Dec. 23, 2010

(30) Foreign Application Priority Data

Sep. 17, 2007 (WO) ..... PCT/NL2007/000228

(51) Int. Cl.
*B67D 7/76* (2010.01)

(52) U.S. Cl.
USPC ..... 222/190; 222/321.9

(58) Field of Classification Search ..... 222/190, 222/321.1–321.9, 380, 372, 382, 386, 383.1
See application file for complete search history.

(56) References Cited

U.S. PATENT DOCUMENTS

| | | | | |
|---|---|---|---|---|
| 5,147,087 | A | 9/1992 | Fuchs | |
| 5,289,952 | A | 3/1994 | Gueret | |
| 5,348,189 | A * | 9/1994 | Cater | 222/1 |
| 6,840,408 | B1 | 1/2005 | Foster et al. | |
| 7,066,359 | B2 * | 6/2006 | Greiner-Perth | 222/321.2 |
| 7,735,692 | B2 * | 6/2010 | Nelson | 222/190 |

FOREIGN PATENT DOCUMENTS

| | | |
|---|---|---|
| EP | 0 392 238 B1 | 10/1990 |
| EP | 0 511 894 B1 | 11/1992 |
| JP | 11-221500 | 8/1999 |

OTHER PUBLICATIONS

English Abstract of Japanese Publication No. 11221500.
PCT International Search Report and Written Opinion for PCT/NL2007/000228 dated May 20, 2008.
PCT International Search Report and Written Opinion for PCT/NL2008/000200 dated Aug. 18, 2009.

* cited by examiner

*Primary Examiner* — Lien Ngo
(74) *Attorney, Agent, or Firm* — Hoffmann & Baron, LLP

(57) ABSTRACT

The present invention provides a foam dispensing assembly comprising a liquid piston pump, comprising a liquid cylinder and a liquid piston delimiting a liquid pump chamber, and a liquid inlet and outlet, an air piston pump comprising an air cylinder and an air piston delimiting an air pump chamber, and an air inlet and outlet, a common actuation button for actuation of said liquid pump and said air pump, a dispensing channel for mixing and dispensing liquid and air pumped by said liquid and air pump, respectively, and a securing collar for attachment of said dispensing assembly to a container. The invention is characterized in that said air cylinder is formed by a cylindrical skirt of said actuation button, and said air piston is at least partially formed by a cylindrical extension of said securing collar and in that said air chamber at least partially surrounds said liquid chamber.

26 Claims, 5 Drawing Sheets

FOAM DISPENSING ASSEMBLY

CROSS-REFERENCE TO RELATED APPLICATIONS

This application is the National Stage of International Application No. PCT/NL2008/000200, filed Sep. 10, 2008, which claims the benefit of National Stage of International Application No. PCT/NL2007/000228, filed Sep. 17, 2007, the contents of which is incorporated by reference herein.

FIELD OF THE INVENTION

The present invention relates to a dispensing assembly for dispensing a liquid, in particular a foam.

BACKGROUND

Pump assemblies to be mounted on a container containing a foamable liquid, which upon actuation provide a foam are well known in the art. For instance, U.S. Pat. No. 5,443,569 discloses such dispensing assembly, the contents of which are herein incorporated in its entirety by reference.

This known dispensing assembly comprises a liquid piston pump and an air piston pump concentrically arranged with respect to each other. The cylinders of the liquid and air pump are formed by the inner cylinder and outer cylinder of a double cylinder, respectively. The dispensing assembly further comprises a common actuation button for simultaneous actuation of the liquid pump and the air pump by manual depression of the actuation button. A liquid piston and an air piston are reciprocally movable arranged in the liquid and air cylinder and are operatively connected to the actuation button so that upon actuation of the actuation button the liquid piston and the air piston may reciprocally be moved in the liquid and air cylinder, respectively.

When the above dispensing assembly is mounted on a container containing a foamable liquid, this liquid may be drawn out of the container by actuation of the actuation button. At the same time air will be pumped by the air pump. The pump outlets of the liquid and air pump are connected to a mixing chamber where the liquid and air is mixed to a (pre) foam. The mixture of liquid and air is consequently pumped through a dispensing channel and passes one or more porous elements, for instance sieves, to form a homogeneous foam which is dispensed at a dispensing opening at the end of the dispensing channel.

Although the above pump has been shown to be very successful in the market for a variety of foamable liquids, such as soap, shampoo, dishwashing detergent and sun cream, there may still be some further improvements possible. Furthermore, since the dispensing assembly of the above type is more and more applied as a mass product there is a continuos strive for simplification, while maintaining a good foam quality.

Generally, it is desirable to dispense a desired quantity of foam per stroke of the actuation button. Further, the length of a stroke is limited for handheld foam dispensers since the actuation button is depressed by a finger while the dispensing device is held by the same hand. Due to the required diameter of the double cylinder to dispense a certain quantity of foam and the limited stroke, the neck opening of the container has to be of a certain minimum diameter to receive the double cylinder of appropriate size. In some applications it is desirable to use containers having a neck opening with a smaller diameter, while maintaining the same stroke length and the same quantity of foam dispensed per stroke. The known dispensing assembly design until now cannot fulfill these requirements on dispensing quantity and dimensions.

SUMMARY OF INVENTION

It is desirable to provide an alternative embodiment of a dispensing assembly being economically attractive while maintaining a good foam quality.

According to an aspect of the invention, there is provided a dispensing assembly mountable on a container for dispensing a foam, comprising:

a liquid piston pump, comprising a liquid cylinder and a liquid piston delimiting a liquid pump chamber, and a liquid inlet and a liquid outlet, an air piston pump comprising an air cylinder and an air piston delimiting an air pump chamber, and an air inlet and an air outlet, a common actuation button for actuation of the liquid pump and the air pump, a dispensing channel for mixing and dispensing liquid and air pumped by the liquid and air pump, respectively, and a securing collar for attachment of the dispensing assembly to a container.

The dispensing assembly is characterized in that said air cylinder is formed by a cylindrical skirt of said actuation button, and said air piston is at least partially formed by a cylindrical extension of said securing collar and in that a piston seal is arranged between the cylindrical extension and the skirt, said piston seal being displaceable with respect to said cylindrical extension in at least a closed position in which the piston seal provides an air tight seal between environmental air and said air pump chamber, and an open position in which introduction of air into the air pump chamber between the cylindrical extension and the skirt is possible.

The above dispensing assembly is of a relative simple and compact design. It has shown that this design may result in a dispensing assembly which has a relatively low height per dispensed volume of foam. Also, the volume of plastics material and thus the weight of the dispensing assembly per volume of dispensed volume of foam per pump stroke is relatively low.

Furthermore, by providing an air pump outside the neck portion of the container it is possible to use a neck opening of a smaller size without requiring a substantial longer stroke length or obtaining less foam per pump stroke.

As the air cylinder is formed by a cylindrical skirt of the actuation button and the air piston is formed by a cylindrical extension of the securing collar, the actuation button extends about the cylindrical extension of the securing collar. As a result, water which will flow over the actuation button will flow down the outside of the dispensing assembly without entering the dispensing assembly. Thus the dispensing assembly can easily be rinsed off under a tap without the risk of water entering the dispensing assembly. Such dispensing assembly is often referred to as a water resistant foamer. The present invention provides a compact foamer which provides water resistancy and a compact construction.

It is remarked that EP 392 238 discloses a dispensing assembly for the dispensing of foam having a piston air pump having an air cylinder formed by a skirt of the actuation button. However, this dispensing assembly is of relatively complex and voluminous design. Furthermore, in this known dispensing assembly, a piston-cylinder arrangement is provided between the air pump and the liquid pump, which is required for the introduction of air in the container to replace liquid which is pumped out of the container. The cylinder of this piston-cylinder arrangement is part of a double cylinder, the second cylinder forming a part of the liquid piston pump. In view of the above, the dispensing assembly of EP 392 238 does not provide the advantages of the dispensing assembly of the present invention.

In the dispensing assembly of the present invention, a piston seal is arranged between the cylindrical extension and the skirt, the piston seal being displaceable with respect to the cylindrical extension in at least a closed position in which the piston seal provides an air tight seal between the environmental air and the air pump chamber, and an open position in which introduction of air into the air pump chamber between the cylindrical extension and the skirt is possible. Such piston seal which opens and closes due to the actuation of the actuation button is advantageous as there is no threshold underpressure required for opening of the valve.

In an embodiment the air chamber at least partially surrounds the liquid chamber. By providing a liquid pump chamber and air pump chamber at least partially surrounding each other, the design of the foam dispensing assembly can be made more compact.

In an embodiment, the piston seal comprises a cylindrical part concentric with a longitudinal axis of said dispensing assembly. By providing a cylindric part in the piston seal the sealing surface of the piston seal can be brought at a different height than the piston sealing lips. As a result, the sealing surfaces of the air inlet valve can be brought closer to and preferably at the same level as the tilting point of the dispensing assembly, i.e. the point about which the dispensing assembly may tilt when the actuation button is not depressed in the direction of the longitudinal axis of the dispensing assembly.

In other embodiments the part concentric with a longitudinal axis of the foam dispenser may have another shape which is concentric with the longitudinal axis of the dispensing assembly, for instance be frusto-conical.

In an embodiment, the piston seal comprises a lip extending towards the longitudinal axis of said dispensing assembly and having a sealing surface which in said closed position provides a sealing engagement with an other part of said dispensing assembly having a corresponding sealing surface. The other part of said dispensing assembly is preferably a surface on the securing collar or a part fixedly connected to the securing collar. The advantage of a sealing lip extending towards the longitudinal axis of the dispensing assembly has the advantage that the sealing surface diameter is smaller than the diameter of a piston sealing part which provides a sealing connection between the piston seal and the skirt. As a result the sealing between the sealing surface of the lip and the corresponding sealing surface may be improved.

In an embodiment the lip is a flexible lip. By providing a flexible lip the sealing between the lip and the cooperating other part of the may further be improved.

Hereinafter further possible features of the compact design of the dispensing assembly of the invention will be discussed. Such features may also be applied in a foam dispensing assembly not having the displaceable piston seal. Such alternative dispensing assembly may have any suitable air inlet valve, for instance the flexible ring of the air inlet valve of EP 392 238.

In an embodiment a bottom end of the liquid cylinder does not project beyond the bottom side of the securing collar. In the case of a transparent container, the liquid cylinder in the known dispensing device is at least partially visible. The liquid cylinder of this embodiment does not have this disadvantage, while at the same time, due to the arrangement of liquid pump and air pump according to the invention, a desired quantity of foam can be dispensed per stroke while having a more compact design of the dispensing assembly which is easy to handle.

In an embodiment, a height of a part of the dispensing assembly projecting after mounting downwardly from the top end of a container is smaller than 1.5 times the maximal stroke length of the actuation button, preferably 1 times the maximal stroke length of the actuation button, or a total height of the dispensing assembly is smaller than 4.5 times the maximal stroke length of the actuation button. Such dimensions of the dispensing assembly provide a good ratio between quantity of foam dispensed per pump stroke, the stroke length and the distance from the container to the top of the actuation button. The latter distance is of importance since the actuation button is designed to be actuated by a finger of the hand holding the dispensing device. It will be clear that the reach of such finger is limited and that this should be taken into account in the design of the dispensing device. The stroke length of a hand-held dispenser having a finger-actuated actuation button lies typically between 5 and 25 mm, more typically between 10 and 20 mm. In preferred embodiments the stroke length is about 11 mm or about 15.5 mm.

It is remarked that the bottom of the liquid inlet valve is regarded to be the bottom side of the dispensing assembly, and the top side of the actuation button is regarded to be the top side of the dispensing assembly. Thus, the dip tube and a part of the connection piece for the dip tube extending downwardly from the liquid inlet valve are not taken into account in the determination of a height of the dispensing assembly.

In an embodiment, the skirt is an integral part of the actuation button and/or the cylindrical extension is an integral part of the securing collar. By making the skirt and/or cylindrical extension integral part of the actuation button, less parts are to be assembled during the manufacturing process of the dispensing assembly.

In an embodiment, the liquid cylinder is at least partially formed by a cylindrical extension of the securing collar. Such embodiment further simplifies the foamer design, wherein both the air piston an the liquid cylinder are supported and preferably are part of the securing collar.

In another embodiment, the liquid cylinder is formed by a cylindric element placed in a recess of the securing collar. Such embodiment provides also a simple design which can be made cost effectively. Such design has the further advantage that it is possible to make the cylindrical element exchangeable for another cylindrical element having the same or a different internal diameter. By exchanging the cylindrical element for an element having a different internal diameter, the quantity of liquid dispensed per pump stroke may be changed, and therewith the ratio between the quantity of liquid and quantity of air which is dispensed per pump stroke.

In an embodiment, the air outlet comprises a part which runs in the upright position of the dispensing device at least partially vertical, an upper end of the at least partially vertically running air outlet being in communication with the air pump chamber, a lower end being in communication with the dispensing channel.

By providing such vertical part in the air outlet foam or liquid present in the mixing chamber cannot flow in the air pump. This is desirable as the presence of foam and/or liquid in the air chamber may result in misfunctioning of the pump. For instance, the seal between the air piston and the air cylinder, may stick together due to solidified liquid on the seal.

In an embodiment, the dispensing assembly comprises a liquid outlet valve in said liquid outlet, wherein said liquid outlet valve comprises a valve seat and a valve member, said valve member being displaceable between a closed valve position, in which the valve member sealingly engages with said valve seat, and an open valve position, in which a gap is formed between the valve member and the valve seat, and wherein said liquid outlet valve further comprises a biasing means to bias said valve member in said closed valve position. By providing biasing means which bias the valve member in the biased position, the closure of the liquid outlet valve can be controlled more accurately. Furthermore, leakage in the up-side-down position of the dispensing assembly, for instance in a wall dispenser, may be avoided by the presence of the biasing means.

In an embodiment, the biasing means comprises one or more spring like elements arranged between the valve member and an inner wall of the dispensing channel and/or a porous element being arranged in said dispensing channel, and the spring like elements are preferably formed by one or more flexible arms fixed to said valve member.

In an embodiment the valve member is a part of an inner rod configured to limit the maximum height of the common actuation button. A known foam dispenser as for instance disclosed in U.S. Pat. No. 5,443,569 comprises a so-called inner rod. The inner rod forms a valve member for the liquid outlet valve as well as a stop member which cooperates with an annular rim which is provided on a tubular element which is arranged in the liquid chamber. The tubular element is typically fixed to the securing collar, while the valve seat is fixed to the common actuation button. As a result the inner rod comprising the valve member limits the maximum height of the common actuation button with respect to the securing collar. Such inner rod improves the sealing of the valve. In the present embodiment this sealing is further improved by the provision of biasing means on the inner rod. Such biasing means further has the advantage that the liquid outlet valve is directly and firmly closed in any position of the actuation button, when there is no longer an over pressure in the liquid pump chamber.

According to a second aspect of the invention there is provided a dispensing assembly The dispensing assembly mountable on a container for dispensing a foam, comprising:

a liquid pump, an air pump a common actuation button for actuation of the liquid pump and the air pump, a dispensing channel for mixing and dispensing liquid and air pumped by the liquid and air pump, respectively, and a securing collar for attachment of the dispensing assembly to a container, characterized in that, the dispensing assembly comprises a sealing gasket, wherein the sealing gasket comprises a sealing part to be placed between the securing collar and the container, and a radially inwardly extending flexible part to be placed sealingly against an inner rim of the dispensing assembly, the flexible part forming an inlet valve element for aeration of the container.

By combination of the sealing gasket and the aeration inlet valve in a single element an attractive aeration valve is obtained. Furthermore, since the airflow path for the aeration may run through the space between the securing collar and the neck portion of the container, the design of the liquid pump and air pump is not importantly influenced by the requirement of an aeration air flow path. This is in contrast to many prior art dispensing assemblies in which the aeration air flow path has a large influence on the design of the liquid and/or air pump.

The embodiment of the present invention has the further advantage that since the flexible lip extends radially inwardly, i.e. substantially perpendicular to the longitudinal axis of the dispensing assembly, fluid will come to rest on the flexible lip when the container is turned upside down, therewith improving the sealing between the flexible lip and the rim of the dispensing assembly. Thus the chance on leaking of the aeration valve is therewith substantially reduced.

In an embodiment, the sealing gasket defines at least one substantially radially extending air channel, one end of the air channel being in communication with the environment, the other end being in communication with the space at the side of the radially inwardly extending flexible lip which is opposite to the interior of the container.

The air channel may for instance be formed by a hole in the sealing gasket or by grooves arranged in one or both of the abutting surfaces of the sealing gasket or the securing collar.

BRIEF DESCRIPTION OF THE DRAWINGS

Further details and characteristics will now be discussed at the hand of a preferred embodiment of a dispensing assembly of the invention, whereby reference will be made to the appended drawings in which.

DETAILED DESCRIPTION OF THE INVENTION

Figure 1:
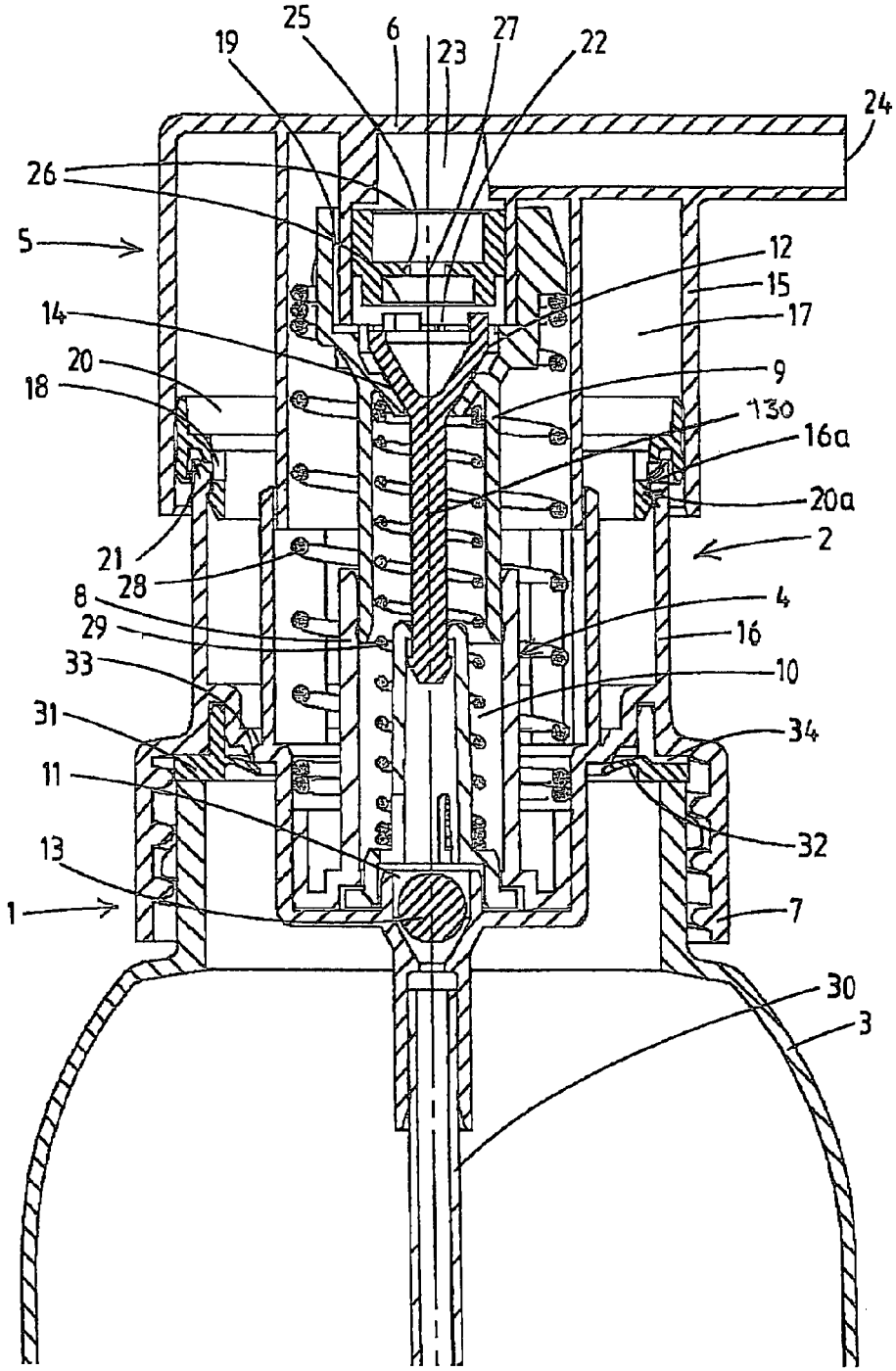
FIG. 1 shows a cross section of a dispensing assembly according to the invention in the rest position of the dispensing assembly.
Figure 2:
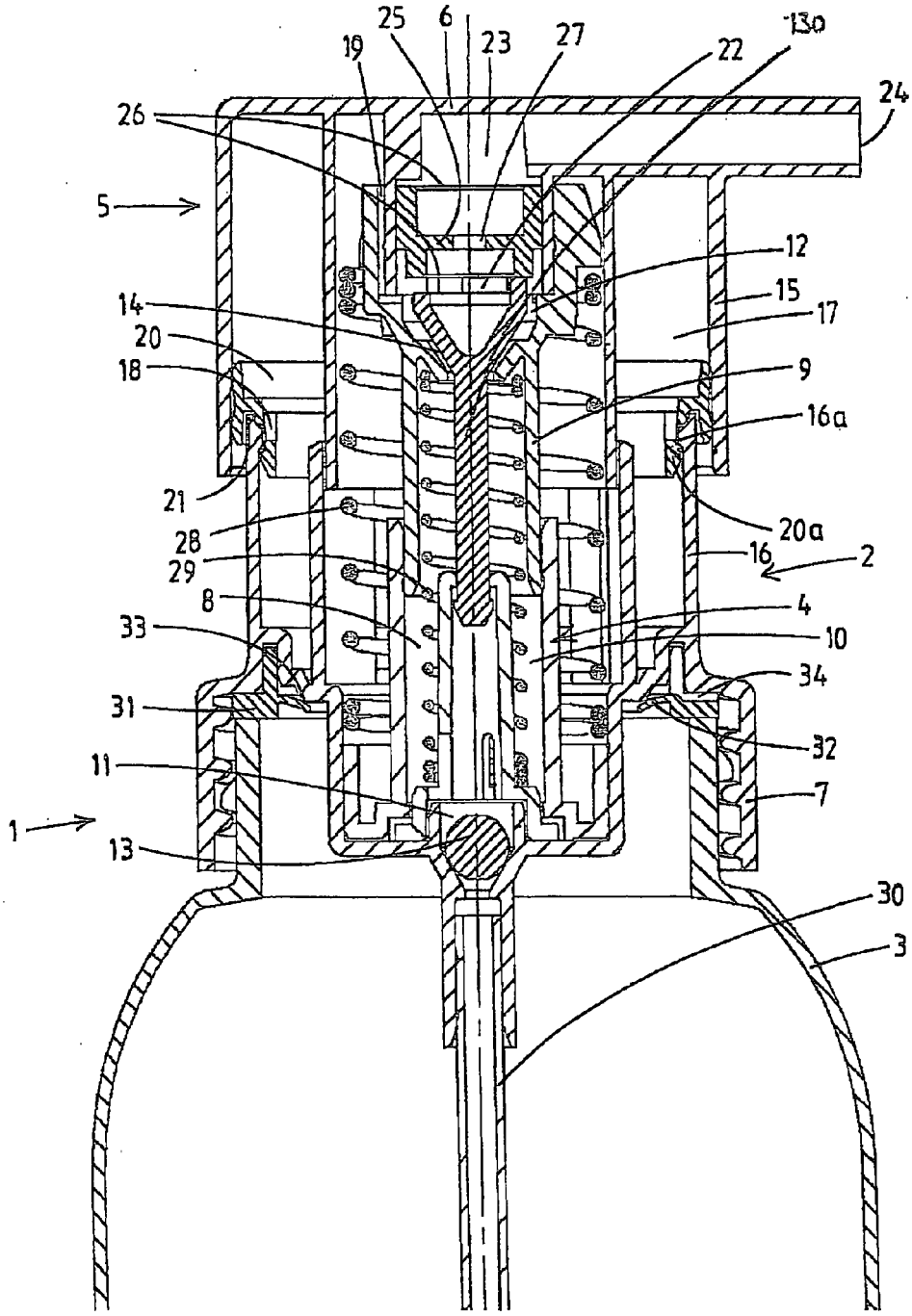
FIG. 2 shows a cross section of a dispensing assembly according to the invention during the downstroke movement of the actuation button.

FIGS. 1 and 2 show an embodiment of a foam dispensing device according to the invention, generally indicated with the reference numeral 1. The dispensing device 1 comprises a dispensing assembly 2 and a container 3 for holding a foamable liquid. The foamable liquid may be mixed with air to form a foam which may be dispensed by actuation of the dispensing assembly 2. The foam may be for any suitable application such as soap, shampoo, sun cream, dishwashing detergent, and shaving cream, etc.

The dispensing assembly 2 comprises a piston-type liquid pump 4, a piston-type air pump 5 and a common actuation button 6. A securing collar 7 is provided to mount the dispensing assembly 2 on the container 3. For this purpose the securing collar 7 comprises an internal screw thread which is configured to cooperate with a screw thread provided about the neck of the container. Any other type connection between dispensing assembly 2 and the container, such as a snap connection, or bayonet catch may also be used.

A sealing gasket 31 is provided between the securing collar 7 and the container 3 to provide a sealing engagement. The sealing gasket 31 comprises a flexible lip 32 extending radially inwardly. A free end of the flexible lip 32 lies sealingly against a rim 33 formed at the bottom side of the securing collar 7. An air channel 34 is provided in the sealing gasket to provide communication between the environment and the space at the side of the flexible lip 32 opposite of the interior of the container 3. When the pressure in the container 3 decreases due to liquid being pumped out of the container, air may enter the container via the air channel 34 and the flexible lip 32 which will come free from the rim 33 due to the underpressure in the container 3 to avoid that the pressure in the container will become too low which may result in deformation of the container and malfunctioning of the liquid pump 4.

The substantially horizontally extending lip 32 has the advantage that when the dispensing device 1 is turned upside down, the liquid in the container will come to rest on the flexible lip 32 and will therefore press the flexible lip 32 against the rim 33. In this way the sealing of the container is improved and leakage through the aeration channel 34 is substantially avoided. The air channel 34 is formed by a groove in the sealing gasket. The air channel 34 may also be formed by a groove in the securing collar 7 or a through-going hole in the sealing gasket 31 or the securing collar 7.

The liquid pump 4 comprises a liquid cylinder 8, and a liquid piston 9 reciprocally movable in said liquid cylinder 8. The liquid cylinder 8 and liquid piston 9 delimit a liquid pump chamber 10. The liquid pump 4 further comprises a liquid inlet 11 and a liquid pump outlet 12. The liquid inlet 11 is connected with a dip tube 30 which runs to the bottom of the interior of the container 3.

A liquid inlet valve 13 is provided in the liquid inlet 11, and a liquid outlet valve 14 is provided in the liquid outlet 12 to control the entering and departure of liquid from the liquid pump chamber 10. The liquid inlet valve 13 is a ball valve which is opened by creation of an underpressure in the liquid pump chamber 10 with respect to the pressure in the interior of the container 3 and closed by an overpressure in the liquid pump chamber 10 with respect to the pressure in the interior of the container 3. The opening and closing of the liquid outlet valve 14 is controlled by the depression and release of the actuation button 6. Such valve is known in the art and for instance described in U.S. Pat. No. 5,443,569. Any other suitable type of liquid outlet valve may also be applied.

The air pump 5 comprises an air cylinder 15 and an air piston 16 reciprocally movable in said air cylinder 15. The air cylinder 15 and air piston 16 delimit an air pump chamber 17. The air cylinder is formed by an integral cylindrical skirt of the actuation button 6. The air piston 16 is formed by an integral cylindrical extension of the securing collar 7. Such construction is advantageous since the air cylinder and piston are formed by the actuation button 6 and the securing collar 7 and thus no separate parts have to be provided.

The air pump 5 further comprises an air inlet 18 and an air outlet 19. A piston seal 20 is mounted on the air piston 16. The piston seal 20 sealingly engages the air cylinder 15 and the air piston 16, and is movable between two positions with respect to the air piston 16. In a first position as shown in FIG. 1, the piston seal 20 is located in an upper position, i.e. the open position, with respect to the air piston 16. In this position, the air inlet 18 is in communication with the environment and air may flow into the air chamber 17 when there is an underpressure in this air chamber 17 with respect to the environment. In FIG. 2, the piston seal is shown in its lower position, i.e. the closed position, with respect to the air piston 16. In this position the piston seal sealingly contacts the upper rim 21 of the air piston 16 and closes the air inlet 18 from the environment. By moving the piston seal 20 between the open and closed position an air inlet valve is obtained as will be explained in more detail hereinafter.

The liquid outlet 12 and air outlet 19 both end in a mixing chamber 22 which is a part of the dispensing channel 23 running from the mixing chamber 22 to a dispensing opening 24 at the other end of the dispensing channel 23.

In the shown embodiment, the dispensing channel 23 runs through the actuation button 6. In the dispensing channel 23 a foam-forming element 25 is arranged which comprises two sieves 26 and a constriction 27 between the two sieves 26. This foam-forming element 25 is provided to form or improve a foam from a liquid air mixture/foam passing the foam-forming element 25. The sieves 26 are provided to obtain a fine and homogeneous foam.

Due to the constriction 27, the foam will be accelerated in the dispensing channel 23 before passing the sieve 26 which is the closest to the dispensing opening 24. It has shown that the provision of a constriction 27 between the two sieves 26, and the resulting acceleration of the foam improves substantially the quality of the foam dispensed by the dispensing device. In alternative embodiments the constriction 27 may also be provided at another location in the dispensing channel 23 with respect to the sieves 26, but is preferably located in the dispensing channel 23 downstream of at least one porous element, for instance a sieve 26.

Starting from the position shown in FIG. 1, the actuation button 6 may be moved downwards by pressing on top of the actuation button 6. As a result, the actuation button 6 and therewith the liquid piston 8 and air cylinder 15 will start to move downwards. When, the actuation button 6 is depressed for the first time, there will be no liquid present in the liquid pump. Due to the friction between the piston seal 20 and the air cylinder 15, the piston seal 20 will initially remain its position with respect to the air cylinder 15 and, as a result, the piston seal 20 will move from the opened position to the closed position (see FIG. 2).

By further depression of the actuation button the air cylinder 15 will further move downwards, therewith decreasing the volume of the air chamber 17. As a result, air present in the air chamber 17 will be pumped out of the air chamber 17 via the air outlet.

When at the end of the downwardstroke the actuation button 6 is released, the pump actuation button 6 is pressed upwards by the springs 28 and 29. The air cylinder 15 which is an integral part of the actuation button 6, will also move upwards and take the piston seal 20 along due to the friction between the air cylinder 15 and the piston seal 20. As a result, the piston seal 20 will move from the closed position to the open position with respect to the air piston 16. When the piston seal 20 is fully in the open position a rim 20A on the piston seal 20 will cling behind a corresponding rim 16*a* on the air piston 16. As a consequence, the sealing rim 20 will no longer move upwards with the air cylinder 15, but stick to the air piston 16. By this movement of the piston seal 20 with respect to the air cylinder 16 the air inlet valve is opened.

It is remarked that in the embodiment shown in FIGS. 1 and 2 two springs 28 and 29 are provided. These springs are arranged in the dispensing assembly to provide extra return spring force. When such extra spring force is not required only the inner spring 29 may be provided, or, in an alternative embodiment wherein it is desirable that the return spring does not come into contact with the pumped liquid only outer spring 28 may be provided. The latter may be the case for certain liquids, for instance corrosive liquids as the springs are typically made of metal, or liquids which are contaminated by contact with metal.

When the air cylinder 16 further move upwards the volume of air chamber 17 will increase and as a consequence air will be sucked into the air chamber 17 via the air inlet 18.

At the same time, the volume of the liquid chamber 10 increases which results in an underpressure in the liquid chamber 10. This underpressure opens the liquid inlet valve 13 and liquid is sucked out of the container 3 through the dip tube 30 and the liquid inlet 11.

When the actuation button 6 is again in its top position as shown in FIG. 1, the liquid chamber 10 and the air chamber 17 are filled with air and liquid, respectively. When the actuation button 6 is again moved downwards, air will be pumped out of the air chamber 17. Now, since the liquid chamber 10 is also filled with liquid, during the downward stroke liquid will be pumped out of the liquid chamber 17 via the liquid outlet 12. The liquid coming from the liquid outlet 12 and air coming from the air outlet 19 are mixed in the mixing chamber 22 to form a (pre)foam which is pumped through the dispensing channel 23 to the dispensing opening 24 where a foam is dispensed. In the dispensing channel 23 the foam/liquid-air mixture passes the foam-forming element 25 to obtain a fine and homogeneous foam.

By further reciprocating movements of the actuation button 6 more foam can be dispensed from the foam dispensing device. It is remarked that although it is described that the foam dispensing device will dispense a foam after one so-called prime stroke, more prime strokes may be required before a desired quantity of foam per pump stroke is dispensed.

After foam has been dispensed, foam will remain in the dispensing channel 23. When the dispensing device is held in the upright position, this foam will run back into the dispensing channel 23 towards the mixing chamber 22. Here it will not flow further in the dispensing device 1 as the liquid outlet 12 is closed by the liquid outlet valve 14 and the air outlet 19 has a vertical part which runs upwards from the mixing chamber 22. As a result, the foam which may turn back to liquid will stay in the mixing chamber 22 and may partially fill the vertical part of the air outlet 19.

The foam and/or liquid in the vertical part of the air outlet 19 can advantageously function as an air outlet valve during the upward movement of the actuation button 6 when air is drawn into the air chamber 17 via the air inlet 18. Due to the presence of the foam/liquid in the air outlet 19, the flow resistance for air coming from the environment is considerably higher in the air outlet 19, than in the air inlet 18. In this way it is avoided that foam/liquid is sucked back into the air chamber 17 without the need for the provision of a mechanical air outlet valve in the air outlet 19. This is desirable as the presence of foam/liquid may have a negative effect on the functioning of the air pump 5. In particular, the foam/liquid may have a negative effect on the sliding sealingly engagement between the air cylinder 15, the air piston 16 and the piston seal 20.

The above described pump dispensing assembly provides is relatively compact. It has shown that this design may result in a dispensing assembly which has a relatively low height per dispensed volume of foam. Also, the volume of plastics material and the weight of the dispensing assembly per volume of dispensed volume of foam per pump stroke is relatively low.

The dispensing assembly further has the advantage that it is resistant to water, i.e. it can easily be rinsed with water from the top side of the dispensing assembly without water entering into the dispensing assembly. This water resistancy is in particular obtained by the skirt of the actuation button extending circumferentially about the cylindrical extension extending upwardly from the securing collar, and the aeration valve formed by the sealing gasket which is arranged under the securing collar. It is remarked that in particular for so-called water resistant foamers the dispensing assembly according to the invention provides a relative compact design.

In an embodiment, a height of a part of the dispensing assembly projecting after mounting downwardly from the top end of a container, i.e. the distance with which the dispensing assembly projects into the neck of the container, is smaller than 1.5 times the maximal stroke length of the actuation button, preferably 1 times the maximal stroke length of the actuation button, or a total height of the dispensing assembly is smaller than 4.5 times the maximal stroke length of the actuation button. The part of the dispensing assembly projecting upwardly from the container on which the dispensing assembly is mounted is preferably maximally 3.5 times the maximal stroke length of the dispensing assembly.

It is remarked that the bottom of the liquid inlet valve is regarded to be the bottom side of the dispensing assembly, and the top side of the actuation button is regarded to be the top side of the dispensing assembly. Thus, the dip tube and the connection piece for the dip tube are not taken into account in the determination of a height of the dispensing assembly.

The above dimensions of the dispensing assembly provide a good ratio between quantity of foam dispensed per pump stroke, the stroke length and the distance from the container to the top of the actuation button. The latter distance is of importance since the actuation button is designed to be actuated by a finger of the hand holding the dispensing device. It will be clear that the reach of such finger is limited and that this should be taken into account in the design of the dispensing device. The stroke length of a hand-held dispenser having a finger-actuated actuation button lies typically between 5 and 25 mm, more typically between 10 and 20 mm. In preferred embodiments the stroke length is about 11 mm or about 15.5 mm.

With these stroke lengths the height of the dispensing assembly (from bottom of liquid inlet valve to top of actuation button in rest position) is typically 40-60 mm, and the dispensing assembly projects after mounting on a container maximally 15 mm, preferably maximally 10 mm into the neck of the container. Due to the compact design of the dispensing assembly, the weight of the pump per dispensed ml liquid per pump stroke may in an embodiment be smaller than 15 gr/ml.

Figure 3A:
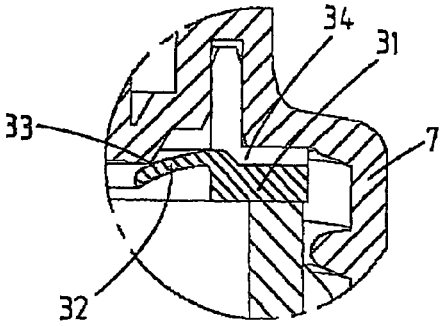
FIGS. 3*a* and 3*b* show the embodiment of the sealing gasket of FIGS. 1 and 2 in more detail.
Figure 3B:
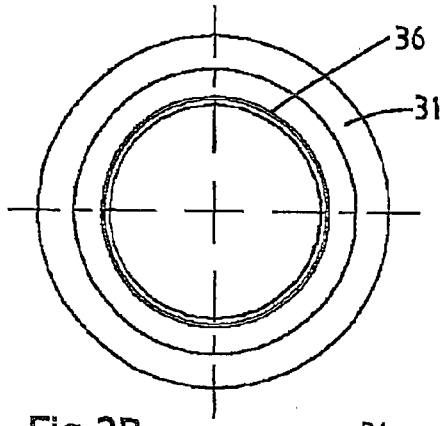

FIGS. 3*a* and 3*b* show the sealing gasket 31 according to the invention in more detail. FIG. 3*a* shows a detail of FIGS. 1 and 2 wherein the parts of the sealing gasket 31 are more clearly shown. FIG. 3*b* shows a view on the bottom side of the sealing gasket 31. On the sealing gasket the sealing surface 36 between the sealing gasket 31 and rim 33 of the securing collar 7 is shown. The sealing surface 26 extends circumferentially about the longitudinal axis of the dispensing assembly.

FIGS. 4*a*-4*d* show top views of alternative embodiments of sealing gaskets according to the invention each having a different sealing surface between the sealing gasket and the securing collar.

Figure 4A:
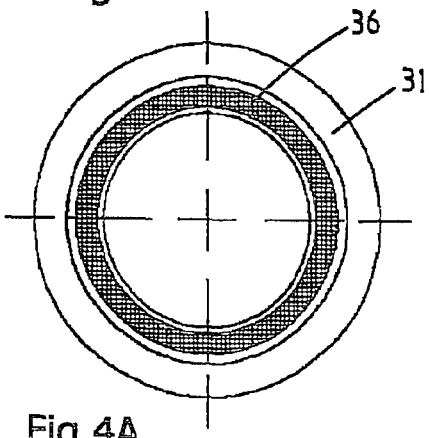
FIGS. 4*a*-4*d* show alternative embodiments of the sealing surface of the gasket of the invention.

FIG. 4*a* shows a sealing surface 36 also extending circumferentially about the longitudinal axis of the dispensing assembly. However, the sealing surface is about the whole circumference broader which may improve the sealing between the sealing gasket and the securing collar depending on the materials used.

Figure 4B:
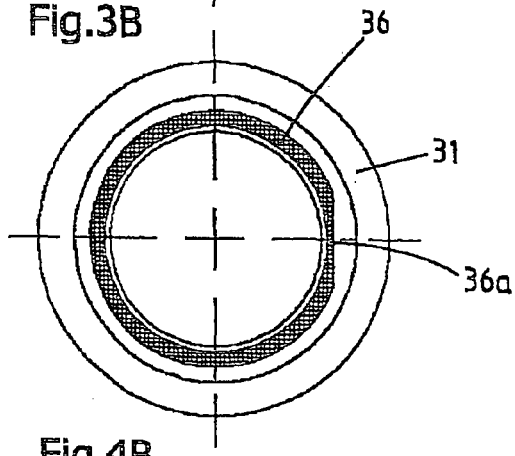

FIG. 4*b* shows a sealing surface 36 extending about the longitudinal axis of the dispensing assembly, but over a part 36*a* of the circumference the sealing surface 36 is smaller than over the rest of the circumference. In some applications such smaller part 36*a* may provide a more controlled opening and closing of the sealing opening between the sealing gasket and the securing collar.

Figure 4C:
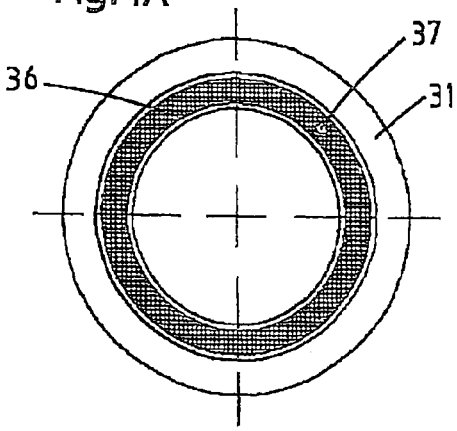

FIG. 4*c* shows a further embodiment of a sealing gasket of the invention. In this embodiment the sealing gasket is provided with a sealing surface 36 substantially corresponding to the sealing surface of FIG. 4*a*, however, a hole 37 is provided through the sealing gasket. Air may flow through this hole from the environment into the container, when the sealing surface 36 at least in the area of the hole 37 is no longer in contact with the securing collar.

Figure 4D:
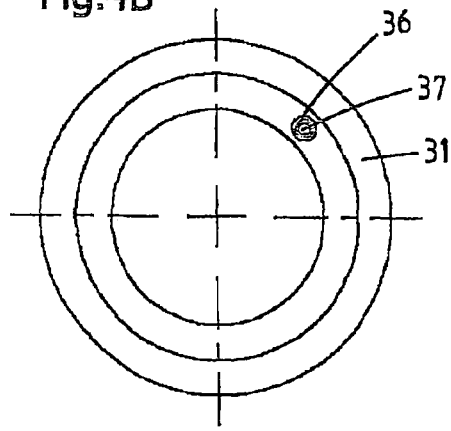

FIG. 4*d* shows a sealing gasket having a hole 37 corresponding to the hole provided in the sealing gasket of FIG. 4*c*, but in this embodiment only a sealing surface is provided about the circumference of the hole 37 itself.

All embodiments of the sealing gaskets of FIGS. 4*a*-4*d* provide attractive alternatives for the sealing gasket of FIGS. 3*a* and 3*b* and are deemed to fall within the scope of the invention.

Figure 5:
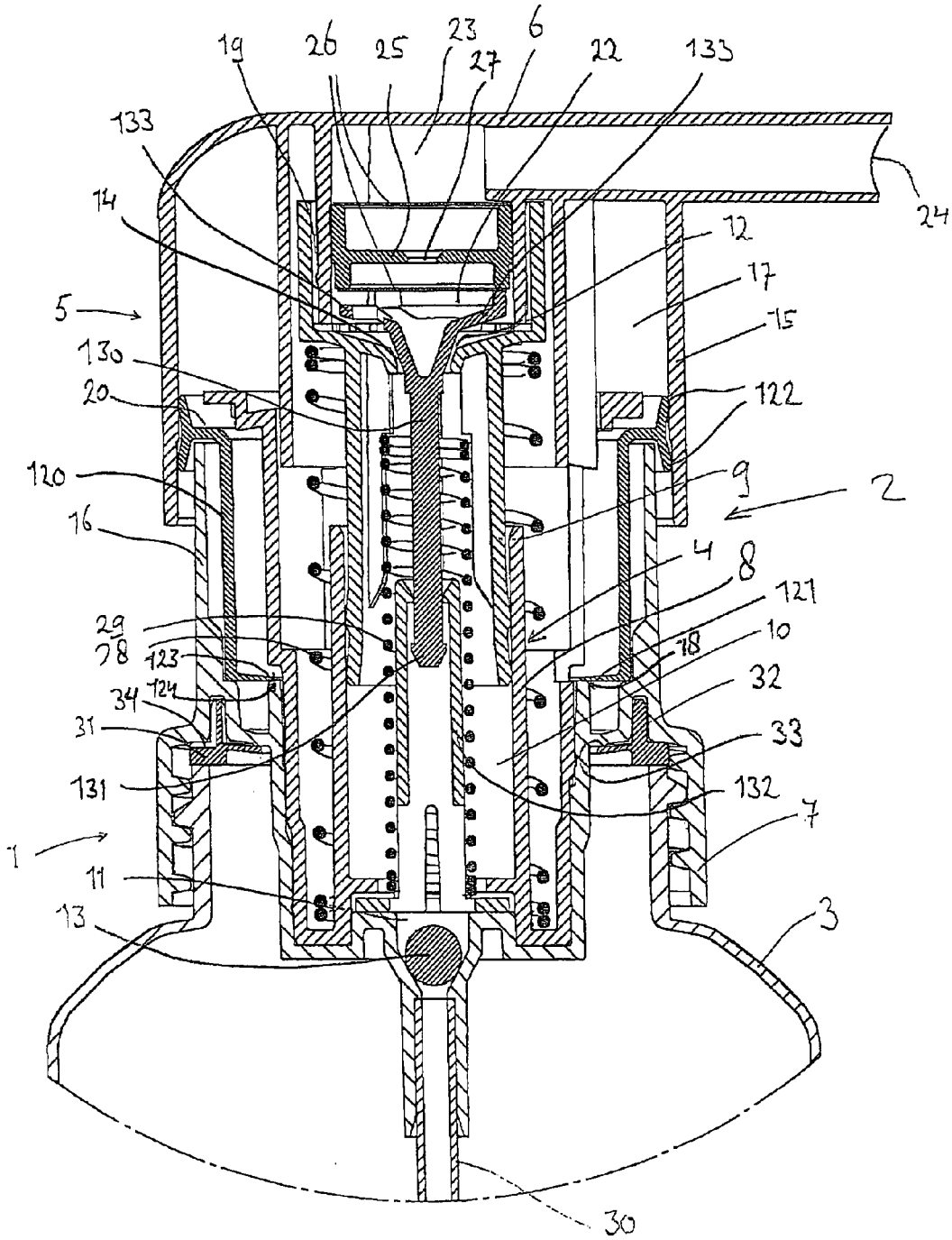
FIGS. 5 and 6 show an alternative embodiment of a foam dispensing device according to the invention.
Figure 6:
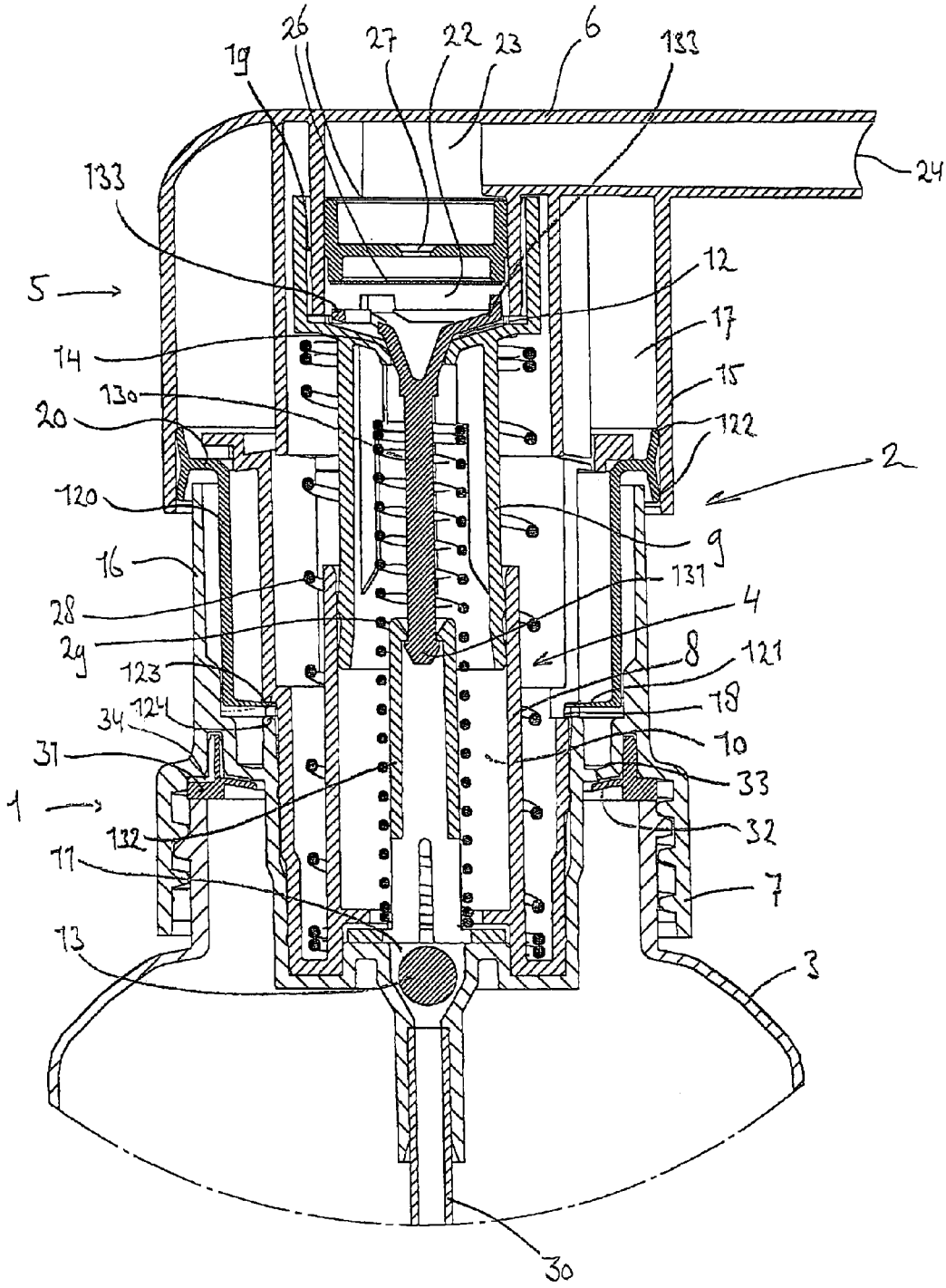

FIGS. 5 and 6 disclose another embodiment of a foam dispensing device according to the invention. Corresponding parts of the embodiment of FIG. 5 and the embodiment of FIGS. 1 and 2 are indicated with the same reference numerals. These parts of the embodiment of FIG. 5 and the function thereof are the same as described with respect to the embodiment of FIGS. 1 and 2 unless described otherwise.

The piston seal 20 of the embodiment of FIGS. 5 and 6 comprises a cylindrical portion 120, a flexible annular sealing lip 121, and two piston sealing lips 122. The annular sealing lip 121 comprises annular sealing surface 123 which together with a sealing surface 124 on a projecting rim of the securing collar 7 forms the air inlet valve. The piston seal 20 is movable between an open position wherein entrance of air in the air pump chamber sealing surfaces 123 and 124 is possible (FIG. 6) and a closed position wherein no air entrance between the sealing surface 123 and 124 is possible (FIG. 5).

The cylindrical portion 120 is provided so that the sealing lip 121 is at another height level than the sealing surface of the two piston sealing lips 122. in particular the height of the sealing surface 121 is chosen such that it is close to, and preferably at the same level as the tilting point of the dispensing assembly 2, i.e. the point of the dispensing assembly 2 about which the dispensing assembly 2 may tilt when the actuation button 6 is not pushed in, in a direction parallel to the longitudinal axis of the dispensing assembly 2. As a result, the sealing between the sealing surfaces 123 and 124 will less be influenced by tilting of the dispensing assembly 2 when the pump actuation button 6 is not depressed correctly.

The annular sealing lip 121 has the advantage that as the sealing lip 121 extends inwardly to the longitudinal axis of the dispensing assembly 2, the sealing surface 123 has a substantial smaller diameter than the air cylinder 15, i.e. where the piston seal 20 abuts the inner surface of the air cylinder 15. Therewith the sealing is substantially improved. This sealing is further improved by the flexibility of the sealing lip 121.

In the dispensing assemblies shown in FIGS. 1 and 2, 5 and 6, an inner rod 130 is provided. The inner rod is elongate and comprises at its upper end a valve member which together with a valve seat provides the liquid outlet valve 14. At the lower end of the inner rod 130, a stop member 131 is provided. This stop member 131 is arranged in a tubular element 132 having an opening through which the inner rod 130 runs. However, the diameter of the opening of the tubular element 132 is smaller than the stop member 131. Thus, the movement of the inner rod 131 in upward direction is limited by the combination of the stop member 131 and the opening in the tubular element 132. In a similar way the downward movement of the inner rod is limited by the combination of valve member and valve seat of the liquid outlet valve 14. Furthermore, the tubular element 132 is connected to the securing collar 7 and the valve seat of the liquid outlet valve 14 is connected to the pump actuation button 6. As a result, in the rest position of the dispensing assembly 2 the springs 28, 29 press the pump actuation button 6 away from the securing collar 7. However, due to the presence of the inner rod, the maximum distance between the actuation button 6 and the securing collar 7 is limited. In the top position of the pump actuation button 6, the stop member 131 is pushed against the rim of the opening of the tubular element 132 and the valve member of the liquid outlet valve 14 is pushed against the valve seat therewith providing a sealing of the liquid outlet valve.

To further improve the sealing between the valve member and the valve seat of the liquid outlet valve, the inner rod of the embodiment of FIGS. 5 and 6 is provided with flexible arms 133 which are biased against the foam-forming element 25, therewith increasing the force with which the valve member is pushed against the valve seat. The flexible arms 133 have the advantage that after a dispensing stroke has ended and the springs push the actuation button to the rest position, the flexible arms 133 directly push the valve member firmly against the valve seat. When only an inner rod is available as shown in FIGS. 1 and 2, the valve member will only be firmly pulled against the valve seat when the actuation button is again in its top position, i.e. when the upstroke is ended by the inner rod 131 being held and the stop member 131 is pulled against the opening of the tubular member 132 and the valve member is pulled in the valve seat. This improved sealing of the liquid outlet valve may be advantageous when the dispensing assembly is regularly held in the up-side-down position, in particular during dispensing, which is for instance the case in a wall dispenser.

In an alternative embodiment, the inner rod 131 may be provided with any biasing means for pushing the valve member in the valve seat as soon as there is no over pressure in the liquid pump chamber. Preferably the biasing means are integral with the inner rod 131, and flexible arms 133 have proven to be very suitable as they can be integrally moulded with the inner rod and require not much space.

Furthermore, the biasing means may be placed against an inner rim of the mixing chamber or any suitable other location instead of the foam-forming element 25.

What is claimed is:

1. A dispensing assembly mountable on a container for dispensing a foam, comprising:

a liquid piston pump, comprising a liquid cylinder and a liquid piston delimiting a liquid pump chamber, and a liquid inlet and a liquid outlet, an air piston pump comprising an air cylinder and an air piston delimiting an air pump chamber, and an air inlet and an air outlet, a common actuation button for actuation of said liquid pump and said air pump, a dispensing channel for mixing and dispensing liquid and air pumped by said liquid and air pump, respectively, and a securing collar for attachment of said dispensing assembly to a container, wherein said air cylinder is formed by a cylindrical skirt of said actuation button, and said air piston is formed by a cylindrical extension of said securing collar, wherein the cylindrical skirt at least partially surrounds the cylindrical extension, and wherein a piston seal is arranged between the cylindrical extension and the skirt, wherein said piston seal is displaceable with respect to said cylindrical extension in by an actuation movement of the common actuation button with respect to the cylindrical extension between at least a closed position in which the piston seal provides an air tight seal between environmental air and said air pump chamber, and an open position in which introduction of air into the air pump chamber between the cylindrical extension and the skirt is possible.

2. The dispensing assembly of claim 1, wherein said air chamber at least partially surrounds said liquid chamber.

3. The dispensing assembly of claim 1, wherein the piston seal in said closed position provides an air tight seal between the cylindrical extension and the skirt.

4. The dispensing assembly of claim 2, wherein said piston seal comprises a first end configured to sealingly engage with said air cylinder, a second end to abut against an inner side of said air piston, and an intermediate part comprising a sealing surface to sealingly engage with a top end surface of said air piston.

5. The dispensing assembly of claim 2, wherein said air inlet is formed by at least one air channel in said piston seal.

6. The dispensing assembly of claim 4, wherein said second end of said piston seal comprises a rim to cooperate with a rim on an inner surface of said piston.

7. The dispensing assembly of claim 4, wherein said first and second end extend in a first direction, and said intermediate part extends in a second direction substantially perpendicular to said first direction.

8. The dispensing assembly of claim 2, wherein said piston seal comprises a cylindrical part concentric with a longitudinal axis of said dispensing assembly.

9. The dispensing assembly of claim 2, wherein the piston seal comprises a lip extending towards the longitudinal axis of said dispensing assembly and having a sealing surface which in said closed position provides a sealing engagement with another part of said dispensing assembly having a corresponding sealing surface.

10. The dispensing assembly of claim 8, wherein said piston seal comprises:

a cylindrical part being arranged substantially concentrical with a longitudinal axis of said dispensing assembly, a piston sealing part being arranged near one end of the cylindrical part and being configured to be in sealing contact with said skirt during a dispensing stroke, and a sealing lip extending towards said longitudinal axis and being configured to provide, in said closed position, a sealing engagement with an other part of said dispensing assembly having a corresponding sealing surface, and to provide, in said open position, an air entrance gap between said sealing lip and said other part.

11. The dispensing assembly of claim 10, wherein said piston sealing part comprises two annular piston sealing lips configured to provide two spaced apart annular sealing contacts between said piston seal and said skirt.

12. The dispensing assembly of claim 1, wherein a bottom end of said liquid cylinder does not project beyond the bottom side of the securing collar.

13. The dispensing assembly of claim 1, wherein, in a rest position, a height of a part of the dispensing assembly projecting after mounting downwardly from the top end of a container is smaller than 1.5 times the maximal stroke length of said actuation button.

14. The dispensing assembly of claim 1, wherein, in a rest position, a total height of said dispensing assembly is smaller than 4.5 times the maximal stroke length of said actuation button.

15. The dispensing assembly of claim 1, wherein said skirt is an integral part of the actuation button and/or wherein said cylindrical extension is an integral part of the securing collar.

16. The dispensing assembly of claim 1, wherein said liquid cylinder is at least partially formed by a cylindrical extension of said securing collar.

17. The dispensing assembly of claim 1, wherein said liquid cylinder is formed by a cylindric element placed in a recess of said securing collar.

18. The dispensing assembly of claim 17, wherein said cylindrical element is exchangeable for another cylindrical element having the same or a different internal diameter.

19. The dispensing assembly of claim 1, wherein said air outlet comprises a part which runs in the upright position of the dispensing device at least partially vertical, an upper of said at least partially vertically running air outlet being in communication with said air pump chamber, a lower end being in communication with said dispensing channel.

20. The dispensing assembly of claim 1, wherein said dispensing assembly comprises a liquid outlet valve in said liquid outlet, wherein said liquid outlet valve comprises a valve seat and a valve member, said valve member being displaceable between a closed valve position, in which the valve member sealingly engages with said valve seat, and an open valve position, in which a gap is formed between the valve member and the valve seat, wherein said liquid outlet valve further comprises a biasing means to bias said valve member in said closed valve position.

21. The dispensing assembly of claim 20, wherein said biasing means comprises one or more spring like elements arranged between the valve member and an inner wall of the dispensing channel and/or a porous element being arranged in said dispensing channel.

22. The dispensing assembly of claim 21, wherein said spring like elements are formed by one or more flexible arms fixed to said valve member.

23. The dispensing assembly of claim 20, wherein said biasing means and said valve member are formed as an integral element.

24. The dispensing assembly of claim 20, wherein said valve member is part of an inner rod configured to limit the maximum height of the common actuation button.

25. A dispensing assembly mountable on a container for dispensing a foam, comprising:

a liquid piston pump, comprising a liquid cylinder and a liquid piston delimiting a liquid pump chamber, and a liquid inlet and a liquid outlet, an air piston pump comprising an air cylinder and an air piston delimiting an air pump chamber, and an air inlet and an air outlet, a common actuation button for actuation of said liquid pump and said air pump, a dispensing channel for mixing and dispensing liquid and air pumped by said liquid and air pump, respectively, and a securing collar for attachment of said dispensing assembly to a container, wherein said air cylinder is formed by a cylindrical skirt of said actuation button, and said air piston is at least partially formed by a cylindrical extension of said securing collar, and wherein a piston seal is arranged between the cylindrical extension and the skirt, wherein said piston seal is displaceable with respect to said cylindrical extension by an actuation movement of the common actuation button with respect to the cylindrical extension between at least a closed position in which the piston seal provides an air tight seal between environmental air and said air pump chamber, and an open position in which introduction of air into the air pump chamber between the cylindrical extension and the skirt is possible, wherein said piston seal comprises a first end configured to sealingly engage with said air cylinder, a second end to abut against an inner side of said air piston, and an intermediate part comprising a sealing surface to sealingly engage with a top end surface of said air piston.

26. A dispensing assembly mountable on a container for dispensing a foam, comprising:

a liquid piston pump, comprising a liquid cylinder and a liquid piston delimiting a liquid pump chamber, and a liquid inlet and a liquid outlet, an air piston pump comprising an air cylinder and an air piston delimiting an air pump chamber, and an air inlet and an air outlet, a common actuation button for actuation of said liquid pump and said air pump, a dispensing channel for mixing and dispensing liquid and air pumped by said liquid and air pump, respectively, and a securing collar for attachment of said dispensing assembly to a container, wherein said air cylinder is formed by a cylindrical skirt of said actuation button, and said air piston is at least partially formed by a cylindrical extension of said securing collar, and wherein a piston seal is provided that is displaceable with respect to said cylindrical extension by an actuation movement of the common actuation button with respect to the cylindrical extension between at least a closed position in which the piston seal provides an air tight seal between environmental air and said air pump chamber, and an open position in which introduction of air into the air pump chamber between the cylindrical extension and the skirt is possible, wherein said piston seal comprises:

a cylindrical part being arranged substantially concentrical with a longitudinal axis of said dispensing assembly, a piston sealing part being arranged near one end of the cylindrical part and being configured to be in sealing contact with said skirt during a dispensing stroke, a sealing lip extending towards said longitudinal axis and being configured to provide, in said closed position, a sealing engagement with a part of said dispensing assembly having a corresponding sealing surface, and to provide, in said open position, an air entrance gap between said sealing lip and said other part, and wherein a height level of said sealing lip is selected such that is close to the height level of a tilting point of the dispensing assembly.

* * * * *